US011730246B2

(12) United States Patent
Woo

(10) Patent No.: US 11,730,246 B2
(45) Date of Patent: Aug. 22, 2023

(54) SYSTEMS AND METHODS FOR DRYING HAIR

(71) Applicant: Noble Woo, Corona Del Mar, CA (US)

(72) Inventor: Noble Woo, Corona Del Mar, CA (US)

( * ) Notice: Subject to any disclaimer, the term of this patent is extended or adjusted under 35 U.S.C. 154(b) by 935 days.

(21) Appl. No.: 15/769,977

(22) PCT Filed: Oct. 24, 2016

(86) PCT No.: PCT/IB2016/001865

§ 371 (c)(1),
(2) Date: Apr. 20, 2018

(87) PCT Pub. No.: WO2017/068429

PCT Pub. Date: Apr. 27, 2017

(65) Prior Publication Data

US 2019/0053597 A1 Feb. 21, 2019

Related U.S. Application Data

(60) Provisional application No. 62/245,949, filed on Oct. 23, 2015.

(51) Int. Cl.

| | |
|---|---|
| ***F26B 5/14*** | (2006.01) |
| ***A45D 20/50*** | (2006.01) |
| ***A45D 20/00*** | (2006.01) |
| *A45D 24/34* | (2006.01) |

(52) U.S. Cl.

CPC ..... *A45D 20/50* (2013.01); *A45D 20/00* (2013.01); *A45D 2024/345* (2013.01); *A45D 2200/207* (2013.01)

(58) Field of Classification Search

CPC .. A45D 20/00; A45D 20/50; A45D 2024/345; A45D 2200/207

USPC ..... 34/401, 397, 96, 283

See application file for complete search history.

(56) References Cited

U.S. PATENT DOCUMENTS

| | | | | |
|---|---|---|---|---|
| 3,890,984 | A | 6/1975 | Lesetar | |
| 5,765,292 | A | 6/1998 | Chan | |
| 6,732,449 | B2 * | 5/2004 | Evanyk | A45D 20/12 34/96 |
| 8,146,264 | B1 * | 4/2012 | Stefano | A45D 20/12 34/96 |
| 2009/0064529 | A1 * | 3/2009 | Kang | A45D 20/50 34/98 |
| 2011/0209721 | A1 * | 9/2011 | Yahnker | A45D 20/12 132/271 |
| 2015/0216292 | A1 * | 8/2015 | Tweel | A46B 9/06 15/160 |
| 2017/0013932 | A1 * | 1/2017 | Nichols | A45D 24/30 |
| 2017/0027301 | A1 * | 2/2017 | Mazed | A46B 9/023 |
| 2018/0055188 | A1 * | 3/2018 | Potts | A46B 9/023 |

OTHER PUBLICATIONS

International Search Report and Written Opinion from PCT/IB2016/001865 dated Sep. 28, 2017, 13 pages.

* cited by examiner

*Primary Examiner* — John P McCormack

(57) ABSTRACT

Embodiments and technologies described herein generally relate to systems and methods for drying hair. In some embodiments, the drying can be accomplished without using a heat source. In some embodiments, the drying can be accomplished using a mechanical motion or mechanical device.

20 Claims, 7 Drawing Sheets

SYSTEMS AND METHODS FOR DRYING HAIR

BACKGROUND

Drying wet hair is an energy intensive process. For example, the drying mechanism currently used in hair dryers involves heating wet hair to a high temperature to accelerate water evaporation. The use of heat or a heating mechanism has many adverse effects, including high energy consumption due to high power draw of the heating elements inside most hair dryers, which can draw upwards of 2,000 watts. But more importantly, continuous exposure to elevated temperatures can potentially damage hair (i.e., denaturing proteins that make up individual hair strands; in another word, burning hair). Additionally, there are many inherent safety concerns that accompany while using high power/high energy devices in households. High power consumption and high temperature operation inadvertently limit the use of hair dryers to plug-in operations (i.e., connected to an electrical outlet to draw power), and at the same time, demand extreme care while using or operating the dryers with potentially hot surfaces that can burn when inappropriately held. These limitations are some of the cautionary measures that have deterred, for example, an elderly from operating a hair dryer or for some parents to limit or prohibit a child or a teenager from using one without proper supervision.

SUMMARY

Embodiments described herein relate generally to systems and methods for drying an article. In some embodiments, the drying can be accomplished without using a heat source. In some embodiments, the drying can be accomplished using a mechanical device. In some embodiments, the mechanical device used in drying the article includes a high frequency vibration source. In some embodiments, the drying process can be done at low-temperature, for example at room temperature or ambient temperature. In some embodiments, the high frequency source used in the mechanical device can include a sonic or an ultrasonic apparatus.

In some embodiments, the mechanical device used for drying can be configured to use power from an outlet, i.e., by plugging into a power outlet. In some embodiments, the mechanical device used for drying can include an energy source enclosed within the device, for example, a battery, an electrochemical cell or any other energy source that can provide energy to the device. In some embodiments, the battery can be recharged via a solar charger, a mechanical hand-operated charger, or another battery or source of energy. In some embodiments, the mechanical device used for drying can include a port or an inlet for an electrical supply for connecting an external source for the purposes of inputting power, i.e., for charging or as an external electrical supply.

In some embodiments, the mechanical device used for drying can include a communication device, which is configured to communicate with an external device, such as a mobile or cellular phone, tablet, iPad, computer, laptop and/or any other computing device or computing or monitoring system. In some embodiments, the communication device in the mechanical device can be used to send and/or receive data and signal, including indicators, notifications, and/or diagnostic values.

In some embodiments, the technology as described herein is spreading wet hair to create more surface areas by the use of hair separator and sonic or ultrasonic vibrational motion, drying due to the sonic or ultrasonic motion, and optionally, a laminar air flow.

In some embodiments, an apparatus can comprise a hair separator to create surface area of wet hair; and a water remover to mechanically remove water from wet hair. In some embodiments, the hair separator includes a plurality of bristles. In some embodiments, the water remover includes a plurality of bristles. In some embodiments, the apparatus further comprises an air blower to provide a laminar flow of air to remove water molecules. In some embodiments, an apparatus can comprise a first article for separating hair; and a second article for imparting water from hair. In some embodiments, the apparatus further comprises a plurality of vents for providing a laminar flow of air to remove water. In some embodiments, the water remover includes a plurality of bristles. In some embodiments, the second article impart water via a mechanical motion across the hair. In some embodiments, an apparatus comprises a first article for separating hair so as to create a surface area; a second article for imparting water from hair via mechanical contact; and a third article for blowing hair. In some embodiments, the first article includes a plurality of bristles in rows and columns. In some embodiments, an apparatus comprises a substrate containing a sonic/ultrasonic wave source, a surface creating structure disposed on a first surface of the substrate; and an air blower for creating an air flow. In some embodiments, the substrate has a patterned structure. In some embodiments, the patterned structure is a series of posts. In some embodiments, the substrate is adhered to a rotating device.

In some embodiments, a method of drying can comprise separating hair to create a surface area for evaporation of water; mechanically removing water molecules using a plurality of bristles; and removing water molecules by a laminar air flow.

DETAILED DESCRIPTION

Figure 1:
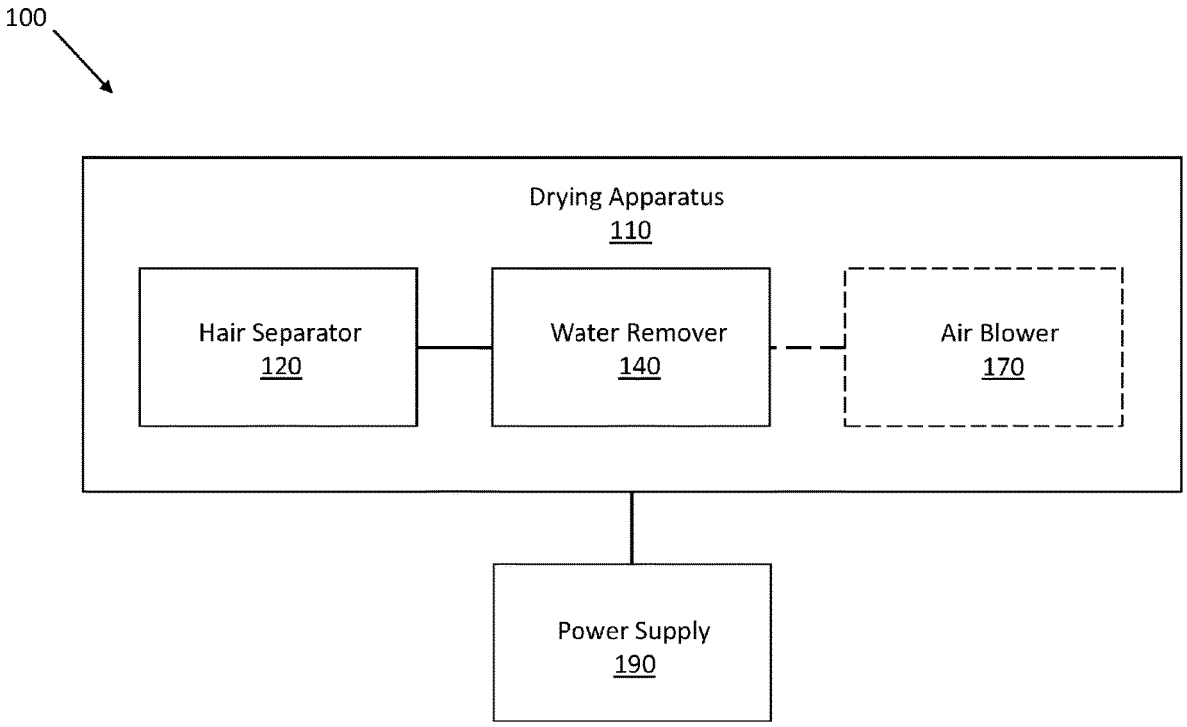
FIG. 1 shows a schematic block diagram of a drying system, according to an embodiment.

Embodiments and technologies described herein generally relate to systems and methods for drying hair. Be it known that, throughout this application, hair is used as an example that is subjected to drying, but the methods and systems as described herein can also be applicable to any other article, including strands, filaments, fibers, etc. of any material or chemical composition, including cottons, nylons, synthetic or natural, organic or inorganic, composite materials etc.

Although drying wet hair can be done naturally in open air, the time it takes to completely dry depends on several factors, such as temperature, humidity level, environmental factors such as wind effect or sun shine, and characteristics of hair including curliness, thickness, length, amount and volume of hair. At the microscopic level, the hair drying process involves temperature-dependent evaporation of water molecules from the surface of wet hair. This evaporation rate depends on the vapor pressure of water for a given temperature, moisture (humidity) level and/or any environmental parameters as mentioned above. In other words, depending on the temperature, pressure, and humidity level of the environment, and the available surface area and morphology of the drying hair, the vapor pressure of water can vary and thus affect the evaporative drying process. Therefore, the drying may take substantially longer. Particularly in damped and moist areas, the hair may not completely dry due to a high humidity level. In most cases, mechanical drying (e.g. using a towel or simply wiping away) helps removing water from wet hair. However, this method does not allow to completely dry in a timely fashion as hair tend to bundle when wet due to surface tension. Furthermore, water molecules absorbed in or holding the hair strands will likely remain wetted to the hair, therefore needing the use of hot air to blow dry in a timely fashion with a traditional blow dryer. Said another way, in the case of bundle hair that has a few strands of hair, overlapping or sticking hair strands in the bundle can effectively hide water in between the individual strands, which may require a longer time to evaporate off the remaining water molecules, unless hair are exposed to a high heat for a prolonged period with a conventional blow dryer.

As alluded to above, water molecules are typically removed from wet hair via an evaporative process using a hair dryer (also referred to as a blow dryer). When drying wet hair using a hair dryer it is typically done at a much higher temperature than natural, ambient or room temperature. For example, a typical and commercially available hair dryer includes a blower with a heating element inside the device that generates hot air with a high enough temperature to evaporate water. When the hot air reaches the (wet) hair, the temperature of the hot air coming out of the blower is high enough so that water molecules have enough energy to evaporate. Said another way, at the molecular level, the hydrogen bonds that are holding the water molecules to form the "liquid" water are broken so that individual water molecules can evaporate. This breaking of hydrogen bond is achieved by an increase in the temperature of the water, which is designed to reach or exceed 100 degree Celsius—the boiling or evaporating point of water at sea level, by definition. The side effect is that since hair is protein and as proteins are water-based, the removal of water molecules from the surface of the hair inevitably and irreversibly removes water molecules from the protein structure as well. Said another way, hair can be burned while using a dryer and the protein in the hair can be irreversibly damaged when exposed to high heat. For wet hair, water molecules inside the bundles hold the individual strands of hair via water tension. For example, if the wet hair agglomerates into several bundles of hair, blow-drying with a hair dryer will usually evaporate the outer/surface water molecules on the bundled hair before reaching the inner water molecules that reside inside the bundled hair. Removing inner water molecules inside the wet bundled hair can over expose high heat to outer hair or individual hair strands that have been completely dried, and the already-dried hair can then be irreversibly damaged due to high heat.

Besides the potential to damage hair, a typical hair dryer consumes about two kilowatts of energy to operate. Therefore, especially given their use in large scale and frequency (on average at least 4-5 times/week per person, especially women), this can lead to substantial energy consumption and unnecessary waste due to inefficiency in the drying (water removal) process. In addition, this is clearly not an efficient process, especially when considering the need of drying a small surface area (e.g., a small bundle of hair stuck together due to water tension). Therefore, not only does continuous application of hot air to the bundled hair lead to burning hair due to excessive heating while attempting to evaporate off the inner water molecules but it can also lead to wasteful high energy consumption. In other words, the blow dryers are very inefficient water removing apparatuses, both in terms of energy efficiency and in operational aspects.

Thermal drying via a hot air blow/hair dryer, albeit with the wide availability of various fan designs and apparatus designs in currently available commercial or professional hair dryers, has additional disadvantages. For example, because of the high energy consumption, the use of the hair dryers are limited to plugged in operations. Because the hair dryers are high energy consumption apparatuses and have the potential to be in contact with water, it is inherently dangerous to use and requires precautions while using. In particular, the use of hair dryers for vulnerable populations, such as children and elderly can be extremely dangerous.

The technology disclosed in this application relates to removal of water molecules from wet hair, or from any surface of an object that has hair-like structures, such as fibers, filaments and strands, etc. An embodiment described herein as an example application is removal of water molecules from hair, i.e., drying hair using the disclosed technology. The benefits of this technology are fourfold—1) low temperature water removal process leads to less damage to the hair; 2) low energy consumption helps reduce cost of operation and potentially curb wastefulness; 3) low power enables safer use even by kids and elderlies; and 4) low power consumption allow for portability, i.e., can be battery operated. Low energy consumption affords the benefit in design and functional flexibility with respect to the configuration of the drying apparatus, as a portable unit that is operated by a battery or any renewable energy source, or to use the power outlet. Reduced power usage can mitigate some of the safety concerns prevalent and associated with high powered hot air blow dryers, that are usually not suitable for use elderlies and kids.

In some embodiments, the drying system as described herein can include a hair separator to increase the surface area of wet hair by using a comb or a brush specifically designed to systematically spread hair. For example, the first row of the brush can include wide spacing teeth or bristles and the second row can include a slightly narrower spacing of teeth or bristles, the third and fourth row even narrower and the last row can include a substantially narrow spacing of teeth or bristles. In this configuration, the hair separator can systematically break the bundling of wet hair to smaller and smaller bundles so as to create more surfaces for evaporation of water molecules during drying. Once the wet hair is spread down to small bundles or even individual hair strands, a water remover of the drying system can help remove water from the wet hair. In some embodiments, the water remover can include one or more rows of bristles with varying lengths, widths, separation between adjacent bristles and aspect ratio. In some embodiments, the water removing bristles are flexible and soft enough to not physically damage the hair. In some embodiments, the water remover bristles can be moved by (or driven) a vibration or mechanical source or a generator to move in a direction so as to strum the hair in a transverse or substantially transverse direction to remove the water molecules of the hair.

In some embodiments, the drying system can further include one or more rows of vents for flowing air in a laminar flow after the water remover strums the hair. In some embodiments, the drying system is configured to create the laminar flow in the direction to push out water molecules that are vibrated off the wet hair so that the water molecules do not get reabsorbed in the hair.

In some embodiments, the drying system can include a hair separator to separate or spread the wet hair so as to create a large surface area for water to easily evaporate, a water remover to mechanically and/or gently strum the hair strands so as to vibrate water molecules off the wet hair, and optionally, an air blower for blowing air in a laminar flow along the travel direction of the drying system with respect to hair so that the removed water molecules do not get absorbed by dried hair.

In other embodiments, a high frequency mechanical vibration or sonic/ultrasonic source or wave generator is situated under, within or on a substrate or a surface of the drying system or apparatus. In some embodiments, the drying apparatus has surface patterns, including, for example, a series of posts, pins, grooves to guide individual hair or smaller bundle of hair when the wet hair comes in contact with the surface of the substrate. In some embodiments, the combination of vibration, sonic/ultrasonic and the patterned contact surface will help spread the wet hair to increase the surface areas of the moist hair, which otherwise may not be possible by simply using a brush. The purpose of the high frequency (sonic/ultrasonic) vibration of the hair is to help accelerate the spreading of hair, particularly wet or moist hair and facilitate the removal of water absorbed on the surface of the hair, even from a single hair strand. The vibration direction can be transverse, substantially transverse or any random direction with respect to the length of hair. This is particularly beneficial when compared with traditional blow drying of wet hair because this technology does not require the use of high temperature. Blow drying typically uses a blow dryer that generates hot air to evaporate water molecules off wet hair.

The use of the sonic or ultrasonic source or high frequency vibration is to help evaporate water molecules without using the high temperature process. By transferring vibrational motion from the sonic/ultrasonic source or high frequency vibrational motion to the wet hair via contact with the patterned surface, the wet hair can be "shaken" to remove water molecules, not just by the vibrational motion, but more importantly by the spreading of wet hair on the patterned surface, even to a single hair strand, allowed by the vibrational motion. With a sonic vibration running approximately about at hundreds to tens of thousands of cycles per minute and with an ultrasonic vibration running approximately up to tens of millions of cycles per minute, the patterned surface with grooves, posts or pins can guide hair much more efficiently than a traditional brush or a comb. This combined with a highly localized laminar air flow will dry a wet hair much more efficiently, faster and at a much lower temperature, i.e., ambient temperature.

In some embodiments, the drying system can be a portable device that can be operated via a battery and hence can be used safely by kids and elderlies. In some embodiments, the apparatus and methods disclosed herein can result in a device that is akin to an electric toothbrush in terms of power consumption and portability. In some embodiments, the apparatus and methods disclosed herein can result in a plugged-in drying device.

FIG. 1 is a schematic illustration of a drying system 100. The drying system 100 (also referred to herein as the "system 100") includes a drying apparatus 110 and a power supply 190. The drying apparatus 110 further includes a hair separator 120 (also referred to herein as the "surface area creator 120"), a water remover 140 (also referred to herein as the "drying mechanism 140"), and optionally, an air blower 170. In some embodiments, the drying system 100 includes the hair separator 120, the water remover 140 and the power supply 190. In some embodiments, the drying system 100 includes the hair separator 120, the water remover 140, the air blower 170, and the power supply 190. The components of the drying system 100 can be configured to remove water molecules from hair (wet hair) effectively and efficiently.

In some embodiments, the drying system 100 can comprise a single apparatus with integrated components of the hair separator 120 and the water remover 140, and the power supply 190 can be coupled to the single apparatus.

In some embodiments, the drying system 100 can comprise a single apparatus with integrated components of the hair separator 120, the water remover 140, and the power supply 190.

In some embodiments, the drying system 100 can comprise a first apparatus with the hair separator 120, the water remover 140, and separately, a second apparatus including the air blower 160, which can be an add-on component configured to couple to the drying system 100. In some embodiments, the drying system 100 can also include the power supply 190 coupled to the drying system 100.

In some embodiments, the drying system 100 can comprise a first apparatus with the hair separator 120, the water remover 140, the power supply 190, and separately, a second apparatus including the air blower 160, which can be an add-on component configured to couple to the drying system 100.

In some embodiments, the hair separator 120 can be used to spread hair (wet hair) and therefore can be like a comb or a brush. In some embodiments, the hair separator 120 can be used to create more surface areas of wet hair so as to increase the surface of exposed water molecules in the bundled or individual strands of hair. Said another way, the hair separator 120 can be like a comb or a brush to separate the wet hair into smaller bundles and/or smaller bundles of hair into individual or a few strands of hair.

In some embodiments, the hair separator 120 can be stationary, rotating or swiveling with respect to drying apparatus 110. In some embodiments, the hair separator 120 can have teeth, bristles, spikes, and the likes of a comb or brush disposed a surface of the drying apparatus 110. In some embodiments, the hair separator 120 can have teeth, bristles, spikes, and the likes of a comb or brush disposed a surface of a hair separator member (not shown), which can be reversibly, permanently and/or semi-permanently coupled to the drying apparatus 110.

In some embodiments, the hair separator 120 can have teeth, bristles, spikes, and the likes of a comb or brush or that are moving to create variable spacing between the teeth can be adjusted to be smaller or larger. In some embodiments, the hair separator 120 can have teeth, bristles, spikes, and the likes of a comb or brush with a gradient in spacing, height, width (or girth), aspect ratio, and other dimensions and/or compositions between adjacent teeth, bristles, spikes, and the likes. In some embodiments, the hair separator 120 can have teeth, bristles, spikes, and the likes of a comb or brush with uniformity (the same or substantially similar) in at least one of spacing, height, width (or girth), aspect ratio, and other dimensions and/or compositions between adjacent teeth, bristles, spikes, and the likes. Said another way, in some embodiments, the hair separator 120 can have a plurality of teeth, bristles, spikes, and the likes of a comb or brush that are similar or identical.

In some embodiments, the dimensions and physical characteristics of teeth, bristles, spikes, and the likes of the hair separator 120 can be substantially similar or identical. In some other embodiments, the teeth, bristles, spikes, and the likes of a comb or brush the surface area creator 140 can vary along any direction on the brush or comb, i.e., the gradient in any direction of the brush or comb. In some embodiments, the hair separator 120 can resemble the shape of an outer surface of a cylindrical-shaped curve comb or brush. In some embodiments, the hair separator 120 can be disposed on a portion of the outer surface of a cylindrical-shaped curve comb or brush. In some embodiments, the hair separator 120 can be disposed on a portion of the outer surface of a semi-circle-shaped, semi-hemispherical-shaped, semi-hyperbolic-shaped or semi-parabolic-shaped curve comb or brush. In some embodiments, the hair separator 120 can be stationary, rotating or swiveling. In some embodiments, the hair separator 120 can be coupled to a rotating mechanism or swiveling mechanism to enable rotating or swiveling with respect to the drying apparatus 110.

In some embodiments, the range of spacing between adjacent teeth, bristles, spikes, and the likes of the hair separator 120 can vary from about 10 microns to about 5000 microns, including about 10 microns, about 20 microns, about 30 microns, about 40 microns, about 50 microns, about 60 microns, about 70 microns, about 80 microns, about 90 microns, about 100 microns, about 120 microns, about 140 microns, about 160 microns, about 180 microns, about 200 microns, about 250 microns, about 300 microns, about 350 microns, about 400 microns, about 450 microns, about 500 microns, about 550 microns, about 600 microns, about 650 microns, about 700 microns, about 750 microns, about 800 microns, about 850 microns, about 900 microns, about 950 microns, about 1000 microns, about 1100 microns, about 1200 microns, about 1300 microns, about 1400 microns, about 1500 microns, about 1600 microns, about 1700 microns, about 1800 microns, about 1900 microns, about 2000 microns, about 2100 microns, about 2200 microns, about 2300 microns, about 2400 microns, about 2500 microns, about 2600 microns, about 2700 microns, about 2800 microns, about 2900 microns, about 3000 microns, about 3100 microns, about 3200 microns, about 3300 microns, about 3400 microns, about 3500 microns, about 3600 microns, about 3700 microns, about 3800 microns, about 3900 microns, about 4000 microns, about 4100 microns, about 4200 microns, about 4300 microns, about 4400 microns, about 4500 microns, about 4600 microns, about 4700 microns, about 4800 microns, about 4900 microns, or about 5000 microns, inclusive of any value therebetween.

In some embodiments, the gradient in the spacing between adjacent teeth, bristles, spikes, and the likes of the hair separator 120 can vary from about 0.1% to 100%, including 0.2%, 0.3%, 0.4%, 0.5%, 0.6%, 0.7%, 0.8%, 0.9%, 1%, 2%, 3%, 4%, 5%, 6%, 7%, 8%, 9%, 10%, 12%, 14%, 16%, 18%, 20%, 25%, 30%, 35%, 40%, 45%, 50%, 55%, 60%, 65%, 70%, 75%, 80%, 85%, 90%, 95%, 96%, 97%, 98%, 99%, 99.9%, 99.99%, or 99.999%, inclusive of any value therebetween.

In some embodiments, the range of height between adjacent teeth, bristles, spikes, and the likes of the hair separator 120 can vary from about 100 microns to about 50,000 microns, including about 100 microns, about 200 microns, about 300 microns, about 400 microns, about 500 microns, about 600 microns, about 700 microns, about 800 microns, about 900 microns, about 1000 microns, about 1200 microns, about 1400 microns, about 1600 microns, about 1800 microns, about 2000 microns, about 2500 microns, about 3000 microns, about 3500 microns, about 4000 microns, about 4500 microns, about 5000 microns, about 5500 microns, about 6000 microns, about 6500 microns, about 7000 microns, about 7500 microns, about 8000 microns, about 8500 microns, about 9000 microns, about 9500 microns, about 10000 microns, about 11000 microns, about 12000 microns, about 13000 microns, about 14000 microns, about 15000 microns, about 16000 microns, about 17000 microns, about 18000 microns, about 19000 microns, about 20000 microns, about 21000 microns, about 22000 microns, about 23000 microns, about 24000 microns, about 25000 microns, about 26000 microns, about 27000 microns, about 28000 microns, about 29000 microns, about 30000 microns, about 31000 microns, about 32000 microns, about 33000 microns, about 34000 microns, about 35000 microns, about 360000 microns, about 37000 microns, about 38000 microns, about 39000 microns, about 40000 microns, about 41000 microns, about 42000 microns, about 43000 microns, about 44000 microns, about 45000 microns, about 46000 microns, about 47000 microns, about 48000 microns, about 49000 microns, or about 50000 microns, inclusive of any value therebetween.

In some embodiments, the gradient in the height between adjacent teeth, bristles, spikes, and the likes of the hair separator 120 can vary from about 0.1% to 100%, including 0.2%, 0.3%, 0.4%, 0.5%, 0.6%, 0.7%, 0.8%, 0.9%, 1%, 2%, 3%, 4%, 5%, 6%, 7%, 8%, 9%, 10%, 12%, 14%, 16%, 18%, 20%, 25%, 30%, 35%, 40%, 45%, 50%, 55%, 60%, 65%, 70%, 75%, 80%, 85%, 90%, 95%, 96%, 97%, 98%, 99%, 99.9%, 99.99%, or 99.999%, inclusive of any value therebetween.

In some embodiments, the range of width between adjacent teeth, bristles, spikes, and the likes of the hair separator 120 can vary from about 10 microns to about 5000 microns, including about 10 microns, about 20 microns, about 30 microns, about 40 microns, about 50 microns, about 60 microns, about 70 microns, about 80 microns, about 90 microns, about 100 microns, about 120 microns, about 140 microns, about 160 microns, about 180 microns, about 200 microns, about 250 microns, about 300 microns, about 350 microns, about 400 microns, about 450 microns, about 500 microns, about 550 microns, about 600 microns, about 650 microns, about 700 microns, about 750 microns, about 800 microns, about 850 microns, about 900 microns, about 950 microns, about 1000 microns, about 1100 microns, about 1200 microns, about 1300 microns, about 1400 microns, about 1500 microns, about 1600 microns, about 1700 microns, about 1800 microns, about 1900 microns, about 2000 microns, about 2100 microns, about 2200 microns, about 2300 microns, about 2400 microns, about 2500 microns, about 2600 microns, about 2700 microns, about 2800 microns, about 2900 microns, about 3000 microns, about 3100 microns, about 3200 microns, about 3300 microns, about 3400 microns, about 3500 microns, about 3600 microns, about 3700 microns, about 3800 microns, about 3900 microns, about 4000 microns, about 4100 microns, about 4200 microns, about 4300 microns, about 4400 microns, about 4500 microns, about 4600 microns, about 4700 microns, about 4800 microns, about 4900 microns, or about 5000 microns, inclusive of any value therebetween.

In some embodiments, the gradient in the width between adjacent teeth, bristles, spikes, and the likes of the hair separator 120 can vary from about 0.1% to 100%, including 0.2%, 0.3%, 0.4%, 0.5%, 0.6%, 0.7%, 0.8%, 0.9%, 1%, 2%, 3%, 4%, 5%, 6%, 7%, 8%, 9%, 10%, 12%, 14%, 16%, 18%, 20%, 25%, 30%, 35%, 40%, 45%, 50%, 55%, 60%, 65%, 70%, 75%, 80%, 85%, 90%, 95%, 96%, 97%, 98%, 99%, 99.9%, 99.99%, or 99.999%, inclusive of any value therebetween.

In some embodiments, the range of aspect ratio between adjacent teeth, bristles, spikes, and the likes of the hair separator 120 can vary from about 1:1 to about 1:10000 of width to height aspect ratio, including 1:1, 1:5, 1:10, 1:15, 1:20, 1:25, 1:30, 1:35, 1:40, 1:45, 1:50, 1:55, 1:60, 1:65, 1:70, 1:75, 1:80, 1:85, 1:90, 1:95, 1:100, 1:120, 1:130, 1:140, 1:150, 1:160, 1:170, 1:180, 1:190, 1:200, 1:250, 1:300, 1:350, 1:400, 1:450, 1:500, 1:550, 1:600, 1:650, 1:700, 1:750, 1:800, 1:850, 1:900, 1:950, 1:1000, 1:1500, 1:2000, 1:2500, 1:3000, 1:3500, 1:4000, 1:4500, 1:5000, 1:5500, 1:6000, 1:6500, 1:7000, 1:7500, 1:8000, 1:8500, 1:9000, 1:9500, or 1:10000, inclusive of any aspect ratio therebetween.

In some embodiments, the water remover 140 can include a plurality of teeth, bristles, spikes, and the likes of a comb or brush. In some embodiments, the plurality of teeth, bristles, spikes, and the likes of a comb or brush of the water remover 140 can be substantially similar to the teeth, bristles, spikes, and the likes, as described with respect to the hair separator 120, and hence can be assumed similar or substantially similar and therefore, will not be described in further detail unless specifically described otherwise.

In some embodiments, the water remover 140 can include a source of mechanical motion (or vibration) to move back and forth or to vibrate the plurality of teeth, bristles, spikes, and the likes of a comb or brush transversely, substantially transverse or any random direction across the (wet) hair strands to remove water. In some embodiments, the water remover 140 can include vibrating the hair strands transversely or substantially in a transverse direction while the hair is under tension along the length of hair by placing the plurality of teeth, bristles, spikes, and the likes of a comb or brush in contact with hair. In some embodiments, the frequency of mechanical motion can be described in terms of vibration frequency. In some embodiments, the water remover 140 can create mechanical vibrations in the frequency range from about 5 Hertz (Hz) to about 5,000,000 Hz (5 MHz), including about 10 Hz, about 20 Hz, about 30 Hz, about 40 Hz, about 50 Hz, about 60 Hz, about 70 Hz, about 80 Hz, about 90 Hz, about 100 Hz, about 110 Hz, about 120 Hz, about 130 Hz, about 140 Hz, about 150 Hz, about 160 Hz, about 170 Hz, about 180 Hz, about 190 Hz, about 200 Hz, about 220 Hz, about 240 Hz, about 260 Hz, about 280 Hz, about 300 Hz, about 350 Hz, about 400 Hz, about 450 Hz, about 500 Hz, about 550 Hz, about 600 Hz, about 650 Hz, about 700 Hz, about 750 Hz, about 800 Hz, about 850 Hz, about 900 Hz, about 950 Hz, about 1000 Hz, about 1100 Hz, about 1200 Hz, about 1300 Hz, about 1400 Hz, about 1500 Hz, about 1600 Hz, about 17000 Hz, about 1800 Hz, about 1900 Hz, about 2000 Hz, about 3000 Hz, about 4000 Hz, about 5000 Hz, about 6000 Hz, about 7000 Hz, about 8000 Hz, about 9000 Hz, about 10000 Hz (10 kHz), about 20 kHz, about 30 kHz, about 40 kHz, about 50 kHz, about 60 kHz, about 70 kHz, about 80 kHz, about 90 kHz, about 100 kHz, about 200 kHz, about 300 kHz, about 400 kHz, about 500 kHz, about 600 kHz, about 700 kHz, about 800 kHz, about 900 kHz, about 1000 kHz, about 1100 kHz, about 1200 kHz, about 1300 kHz, about 1400 kHz, about 1500 kHz, about 1600 kHz, about 1700 kHz, about 1800 kHz, about 1900 kHz, about 2000 kHz (2 MHz), about 2.5 MHz, about 3.0 MHz, about 3.5 MHz, about 4.0 MHz, about 4.5 MHz, or about 5.0 MHz, inclusive of any vibration frequency therebetween.

In some embodiments, the range of movements of the teeth, bristles, spikes, and the likes of a comb or brush in the water remover 140 can be as small as half the width of an individual strand of hair, i.e., about 30 microns, to as large as 5 mm, including any displacement of movements from about 30 microns, about 40 microns, about 50 microns, about 60 microns, about 70 microns, about 80 microns, about 90 microns, about 100 microns, about 120 microns, about 140 microns, about 160 microns, about 180 microns, about 200 microns, about 250 microns, about 300 microns, about 350 microns, about 400 microns, about 450 microns, about 500 microns, about 550 microns, about 600 microns, about 650 microns, about 700 microns, about 750 microns, about 800 microns, about 850 microns, about 900 microns, about 950 microns, about 1000 microns, about 1100 microns, about 1200 microns, about 1300 microns, about 1400 microns, about 1500 microns, about 1600 microns, about 1700 microns, about 1800 microns, about 1900 microns, about 2000 microns, about 2100 microns, about 2200 microns, about 2300 microns, about 2400 microns, about 2500 microns, about 2600 microns, about 2700 microns, about 2800 microns, about 2900 microns, about 3000 microns, about 3100 microns, about 3200 microns, about 3300 microns, about 3400 microns, about 3500 microns, about 3600 microns, about 3700 microns, about 3800 microns, about 3900 microns, about 4000 microns, about 4100 microns, about 4200 microns, about 4300 microns, about 4400 microns, about 4500 microns, about 4600 microns, about 4700 microns, about 4800 microns, about 4900 microns, or about 5000 microns, inclusive of any displacement therebetween.

In some embodiments, the water remover 140 can include a sonic or ultrasonic source to remove water from hair (or wet hair). In some embodiments, the sonic/ultrasonic source in the water remover 140 can create vibrations in the range from about 5 Hertz (Hz) to about 5,000,000 Hz (5 MHz), including about 50 Hz, about 100 Hz, about 200 Hz, about 300 Hz, about 400 Hz, about 500 Hz, about 600 Hz, about 700 Hz, about 800 Hz, about 900 Hz, about 1000 Hz, about 1100 Hz, about 1200 Hz, about 1300 Hz, about 1400 Hz, about 1500 Hz, about 1600 Hz, about 17000 Hz, about 1800 Hz, about 1900 Hz, about 2000 Hz, about 3000 Hz, about 4000 Hz, about 5000 Hz, about 6000 Hz, about 7000 Hz, about 8000 Hz, about 9000 Hz, about 10000 Hz (10 kHz), about 20 kHz, about 30 kHz, about 40 kHz, about 50 kHz, about 60 kHz, about 70 kHz, about 80 kHz, about 90 kHz, about 100 kHz, about 200 kHz, about 300 kHz, about 400 kHz, about 500 kHz, about 600 kHz, about 700 kHz, about 800 kHz, about 900 kHz, about 1000 kHz, about 1100 kHz, about 1200 kHz, about 1300 kHz, about 1400 kHz, about 1500 kHz, about 1600 kHz, about 1700 kHz, about 1800 kHz, about 1900 kHz, about 2000 kHz (2 MHz), about 2.5 MHz, about 3.0 MHz, about 3.5 MHz, about 4.0 MHz, about 4.5 MHz, about 5.0 MHz, and inclusive of any frequency therebetween.

In some embodiments, the air blower 170 can include one or more rows of vents in the drying apparatus 110. In some embodiments, the one or more rows of vents in the drying apparatus 110 are single slits positioned anywhere in the drying apparatus. In some embodiments, the one or more rows of vents in the drying apparatus 110 are single slits positioned altogether in one area of the drying apparatus or spaced in and distributed between other components or other areas of the drying apparatus. In some embodiments, the one or more rows of vents in the air blower 170 can further includes partitions so as to create a proper and effective laminar flow. In some embodiments, the partition can create vents as small as pin holes. In some embodiments, the vents can have one or more openings with cross-section areas of about 0.1 $mm^2$, about 0.2 $mm^2$, about 0.3 $mm^2$, about 0.4 $mm^2$, about 0.5 $mm^2$, about 0.6 $mm^2$, about 0.7 $mm^2$, about 0.8 $mm^2$, about 0.9 $mm^2$, about 1.0 $mm^2$, about 1.1 $mm^2$, about 1.2 $mm^2$, about 1.3 $mm^2$, about 1.4 $mm^2$, about 1.5 $mm^2$, about 1.6 $mm^2$, about 1.7 $mm^2$, about 1.8 $mm^2$, about 1.9 $mm^2$, about 2.0 $mm^2$, about 2.2 $mm^2$, about 2.4 $mm^2$, about 2.6 $mm^2$, about 2.8 $mm^2$, about 3.0 $mm^2$, about 3.5 $mm^2$, about 4.0 $mm^2$, about 4.5 $mm^2$, about 5.0 $mm^2$, about 5.5 $mm^2$, about 6.0 $mm^2$, about 6.5 $mm^2$, about 7.0 $mm^2$, about 7.5 $mm^2$, about 8.0 $mm^2$, about 8.5 $mm^2$, about 9.0 $mm^2$, about 9.5 $mm^2$, about 10 $mm^2$, about 11 $mm^2$, about 12 $mm^2$, about 13 $mm^2$, about 14 $mm^2$, about 15 $mm^2$, about 16 $mm^2$, about 17 $mm^2$, about 18 $mm^2$, about 19 $mm^2$, about 20 $mm^2$, about 21 $mm^2$, about 22 $mm^2$, about 23 $mm^2$, about 24 $mm^2$, about 25 $mm^2$, about 26 $mm^2$, about 27 $mm^2$, about 28 $mm^2$, about 29 $mm^2$, about 30 $mm^2$, about 35 $mm^2$, about 40 $mm^2$, about 45 $mm^2$, about 50 $mm^2$, about 55 $mm^2$, about 60 $mm^2$, about 65 $mm^2$, about 70 $mm^2$, about 75 $mm^2$, about 80 $mm^2$, about 85 $mm^2$, about 90 $mm^2$, about 95 $mm^2$, about 100 $mm^2$, about 110 $mm^2$, about 120 $mm^2$, about 130 $mm^2$, about 140 $mm^2$, about 150 $mm^2$, about 160 $mm^2$, about 170 $mm^2$, about 180 $mm^2$, about 190 $mm^2$, about 200 $mm^2$, about 210 $mm^2$, about 220 $mm^2$, about 230 $mm^2$, about 240 $mm^2$, about 250 $mm^2$, about 260 $mm^2$, about 270 $mm^2$, about 280 $mm^2$, about 290 $mm^2$, about 300 $mm^2$, about 350 $mm^2$, about 400 $mm^2$, about 450 $mm^2$, about 500 $mm^2$, about 550 $mm^2$, about 600 $mm^2$, about 650 $mm^2$, about 700 $mm^2$, about 750 $mm^2$, about 800 $mm^2$, about 850 $mm^2$, about 900 $mm^2$, about 950 $mm^2$, about 1000 $mm^2$, about 2000 $mm^2$, about 3000 $mm^2$, about 4000 $mm^2$, or about 5000 $mm^2$, inclusive of any value therebetween.

In some embodiments, the partition can create vents with aspect ratios, including 1:1 1:2, 1:3, 1:4, 1:5, 1:6, 1:7, 1:8, 1:9, 1:10, 1:15, 1:20, 1:25, 1:30, 1:35, 1:40, 1:45, 1:50, 1:55, 1:60, 1:65, 1:70, 1:75, 1:80, 1:85, 1:90, 1:95, 1:100, 1:120, 1:130, 1:140, 1:150, 1:160, 1:170, 1:180, 1:190, 1:200, 1:250, 1:300, 1:350, 1:400, 1:450, 1:500, 1:550, 1:600, 1:650, 1:700, 1:750, 1:800, 1:850, 1:900, 1:950, or 1:1000, inclusive of all aspect ratio therebetween.

In some embodiments, the power supply 190 can be a power outlet or any alternative current source. In some embodiments, the power supply 190 can be a power outlet or any direct current source. In some embodiments, the power supply 190 can be a battery, fuel cell or any electrochemical energy source, renewable energy source or recharge energy source. In some embodiments, the power supply 190 can provide power to any or all components in the drying system 100 or drying apparatus 110. In some embodiments, the power supply 190 can be inductively recharged via a charging pad. In some embodiments, the power supply 190 can be wirelessly recharged.

In some embodiments, the drying system 100 can include a battery operated water remover 120 or sonic/ultrasonic transducer unit (not shown), and the hair separator 120 is also a battery operated unit, such as for example a battery operated rotating or swiveling comb or brush or any form of mechanical movements of the teeth of the comb, including linear actuation of the teeth to narrow or widen the teeth width. In some embodiments, the water remover 140 (or sonic/ultrasonic source) is a battery-operated unit (or sonic/ultrasonic transducer), but the hair separator 120 is a non-battery operated unit, such as for example a simple comb or brush. In some embodiments, the hair separator 120 can reversibly couple to the drying apparatus 110 or the drying system 100.

In some embodiments, the drying system 100 also includes one or more (integrated or add-on) sensors, including but not limited to, a temperature sensor to measure temperature, a humidity sensor to measure humidity, a timing device that can track time, one or more communication components, such as WiFi, Bluetooth, Near Field Communication, etc., that can connect with an external computing device or network, and a notification system.

In some embodiments, the temperature sensor can be disposed on the drying system 100. In some embodiments, the temperature sensor can be integrated in the drying system 100. In some embodiments, the temperature sensor is used to measure the temperature of air or hair in the vicinity of the drying system 100. In some embodiments, the temperature sensor is used to monitor the change in temperature, initially prior to drying, during drying, and/or after drying.

In some embodiments, the temperature sensor can be any of commercially available sensors, such as infrared sensor, thermocouple, resistive temperature devices, thermistor, and the like. In some embodiments, the temperature sensor can measure temperature via contact mode using an appropriate temperature sensor. In some embodiments, the temperature sensor can measure temperature via non-contact mode using an appropriate temperature sensor.

In some embodiments, the humidity sensor can be disposed on the drying system 100. In some embodiments, the humidity sensor can be integrated in the drying system 100. In some embodiments, the humidity sensor is used to measure the humidity of air or hair in the vicinity of the drying system 100. In some embodiments, the humidity sensor is used to monitor the change in humidity (e.g. relative scale), initially prior to drying, during drying, and/or after drying.

In some embodiments, the humidity sensor can be any of commercially available sensors, such as capacitive humidity sensor, resistive humidity sensor, thermal conductivity humidity sensor, polymeric humidity sensor, and the like. In some embodiments, the humidity sensor can measure humidity via contact mode using an appropriate humidity sensor. In some embodiments, the humidity sensor can measure humidity via non-contact mode using an appropriate temperature sensor.

In some embodiments, the timing device can be integrated in the drying system 100. The timing device can be an internal clock that keeps track of time and can be used as a timer or an alarm.

In some embodiments, the one or more communication components, such as WiFi, Bluetooth, Near Field Communication, etc., can be disposed on the drying system 100. In some embodiments, the one or more communication components, such as WiFi, Bluetooth, Near Field Communication, etc., can be integrated in the drying system 100. In some embodiments, the one or more communication components is used to transfer information to an external computing device, such as a personal computer, a tablet, a cellular phone, or a network entity that can further distribute such information. In some embodiments, the transferred information can include information related to any of temperature, humidity, and time. In some embodiments, the transferred information can also include status of the drying system 100. The status of the drying system 100 can be any indication related to the condition of the drying system 100, such as, normal, low battery power, low-power or Eco mode, plugged-in mode, jammed or mal-functioned, needs maintenance, replace specific part, and the like.

In some embodiments, the notification system in the drying system 100 can include a hardware component that can be used to notify the user. In some embodiments, the notification system can include a software component that can be used to notify the user. In some embodiments, the notification system can include at least one of a display, an audible device, a vibration component, and a light indicator. In some embodiments, the notification system can be integrated in the drying system 100. In some embodiments, the notification system can be added on the drying system 100. In some embodiments, some of the hardware components of the notification system can be disposed on the drying system 100. In some embodiments, the notification system can be software based and included in an external computing device via an application or website-based interface to notify the user of notification information. For example, if a minor/child uses the drying system 100, the status of the drying system 100 can be reported to an external device of a parent/guardian. In some embodiments, the drying system 100 can be used, operated, and/or controlled via an application or website-based interface on an external computing device. In these instances, any one of the aforementioned communication components can be used to enable communication between the drying system 100 and the external computing device. In some embodiments, the notification system can send status report to the external computing device when the drying system 100 gets turned on or off. In some embodiments, the notification system sends status report while the drying system 100 is being used or periodically, or only when a notifiable status report is triggered.

In some embodiments, the display component of the notification system can include a touch screen display. In some embodiments, the display component of the notification system can include a non-touch screen display. In some embodiments, the display can show any information related to the condition of the drying system 100, such as, normal, low battery power, low-power or Eco mode, plugged-in mode, jammed or mal-functioned, needs maintenance, replace specific part, and the like. In some embodiments, the audible device of the notification system can include a speaker that can output an audible beep, chirp, or any sound that can be used to notify the user.

In some embodiments, the vibration component of the notification system can include any vibration system that can be used to notify the user. In some embodiments, the vibration system can include any commercially available vibration module, similar to those used in a cellular phone or a tablet.

In some embodiments, the light indicator of the notification system can include one or more of LED or fluorescent device that can fluoresce. In some embodiments, the one or more of LED or fluorescent device can be discrete LEDs or fluorescent devices. In some embodiments, the one or more of LED or fluorescent device can be in the shape of a ring (light-ring), circle, square or any shape or form. In some embodiments, the one or more of LED or fluorescent device can be of the same color or different colors. In some embodiments, the one or more of LED or fluorescent device can be blinking or non-blinking, i.e., simply on or off. In some embodiments, the quantity of the one or more of LED or fluorescent device can be used to notify. In some embodiments, any of the variation of the one or more of LED or fluorescent device can be used to indicate any indication related to the condition of the drying system 100, such as, normal, low battery power, low-power or Eco mode, plugged-in mode, jammed or mal-functioned, needs maintenance, replace specific part, and the like.

Figure 2A:
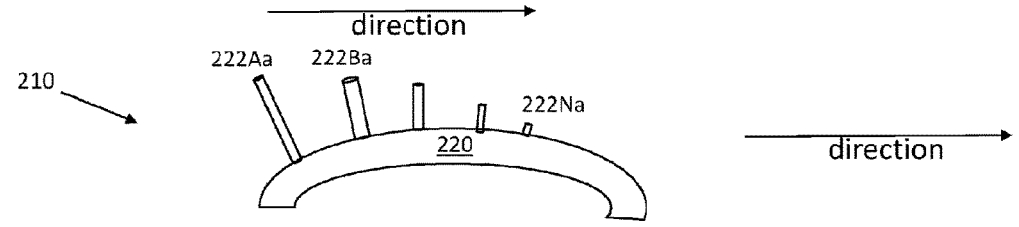
FIGS. 2A-2D show schematic diagrams of a drying apparatus, according to an embodiment.
Figure 2B:
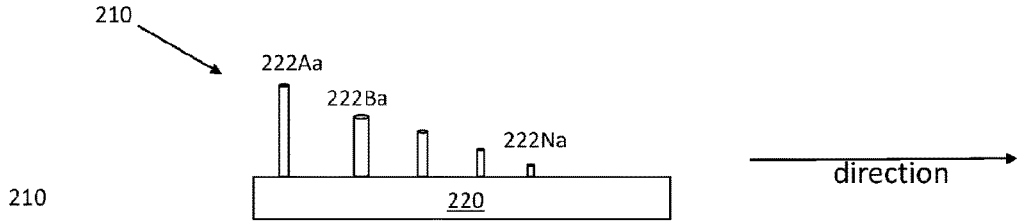

FIGS. 2A-2D show schematic diagrams of a drying apparatus 210, according to an embodiment. In particular, FIG. 2A shows a side view of an embodiment of hair separator 220 which includes a non-planar surface. The hair separator 220 includes a plurality of teeth or bristles, designated as 222Xy in the "X-row" direction and in the "y-column" direction. From the side view as shown in FIG. 2A, the adjacent rows 222Aa, 222Ba, . . . , 222Na have a gradient in height of the teeth or bristles 222. FIG. 2B shows another embodiment of hair separator 220 that includes a planar surface. Similarly, the hair separator 220 includes a plurality of teeth or bristles, designated as 222Xy with adjacent rows 222Aa, 222Ba, . . . , 222Na having a gradient in height. The plurality of teeth or bristles 222 is similar or substantially similar to the teeth, bristles, spikes, and the likes of a comb or brush those described in the hair separator 120 with respect to FIG. 1 and hence will not be described in further detail. In both FIGS. 2A and 2B, the direction of the hair separator 220 with respect to hair is shown along the direction of the arrow as shown.

Figure 2C:
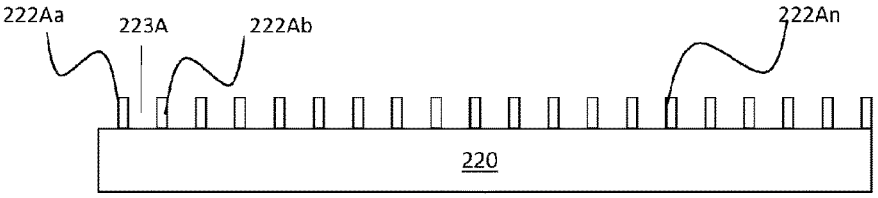
Figure 2D:
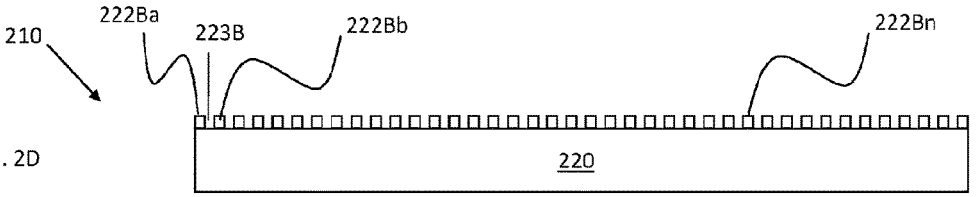

Within each row, the height can be substantially similar as shown in the front views in FIGS. 2C and 2D. FIG. 2C shows the first row 222A that includes the plurality of teeth or bristles 222Aa, 222Ab, . . . , 222An, with a separation spacing 223A between adjacent teeth or bristles. Similarly, FIG. 2D shows the second row 222B that includes the plurality of teeth or bristles 222Ba, 222Bb, . . . , 222Bn, with a separation spacing 223B between adjacent teeth or bristles. In some embodiments, the difference in the separation spacing 223A and 223B can be any of separation spacing within the range of spacing between adjacent teeth, bristles, spikes, and the likes as described with respect to the hair separator 120 in FIG. 1.

Figure 3A:
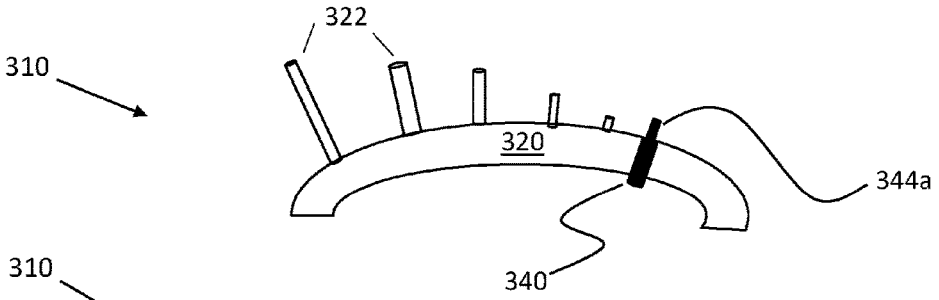
FIGS. 3A-3C show schematic diagrams of a drying apparatus, according to an embodiment.
Figure 3B:
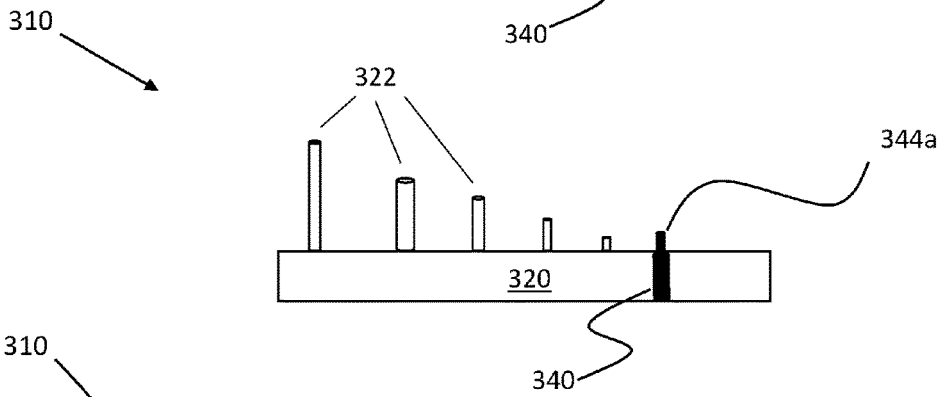
Figure 3C:
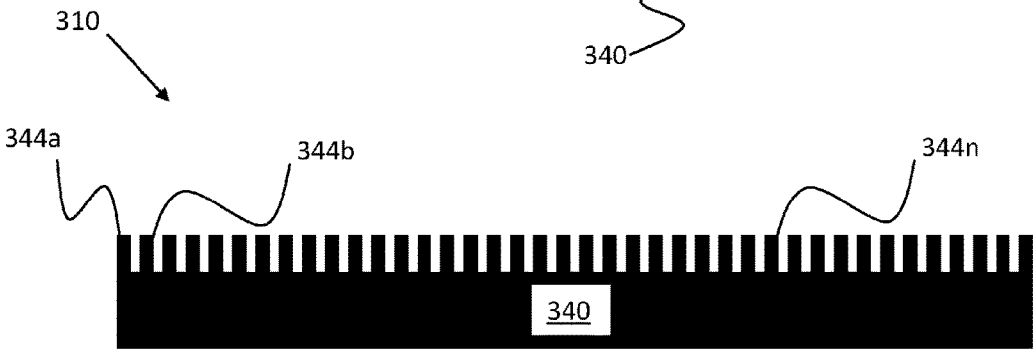

FIGS. 3A-3C show schematic diagrams of a drying apparatus 310, according to an embodiment. In particular, FIG. 3A shows a side view of an embodiment of hair separator 320 which includes a non-planar surface. As shown in FIG. 3A, the hair separator 320 includes a plurality of teeth or bristles 322 with varying dimensions. The drying apparatus 310 also includes a water remover 340 that includes one row of teeth or bristles 344*a* for removing water molecules. FIG. 3B shows a side view of an embodiment of hair separator 320 on a planar or flat surface. The plurality of teeth or bristles 322 is similar or substantially similar to those described with respect to FIG. 1 and hence will not be described in further detail. FIG. 3C shows the front view (cross-sectional) of the water remover 340 without showing the components of the hair separator 320. The plurality of teeth or bristles 344*a*, 344*b*, . . . , 344*n* (collectively "344") is similar or substantially similar to the teeth, bristles, spikes, and the likes of a comb or brush those described in the water remover 140 with respect to FIG. 1 and hence will not be described in further detail.

Figure 4A:
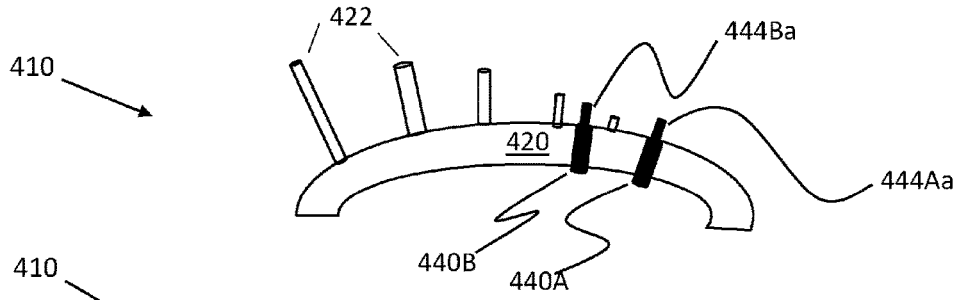
FIGS. 4A-4C show schematic diagrams of a drying apparatus, according to an embodiment.
Figure 4B:
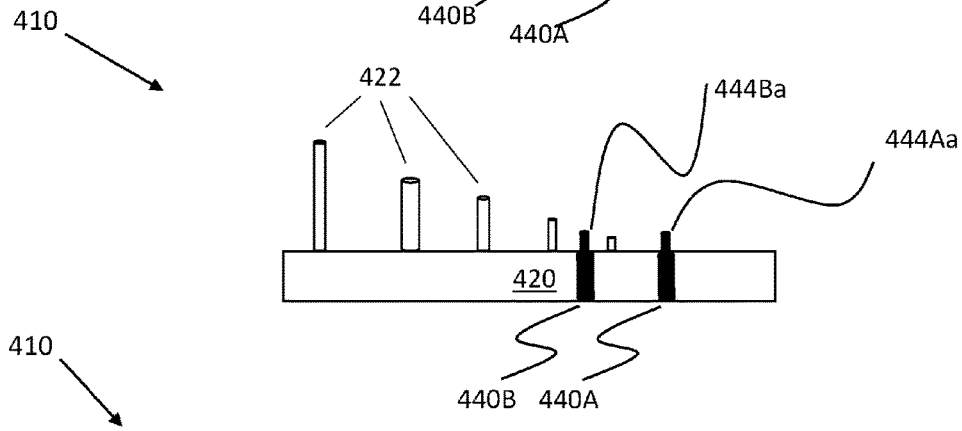
Figure 4C:
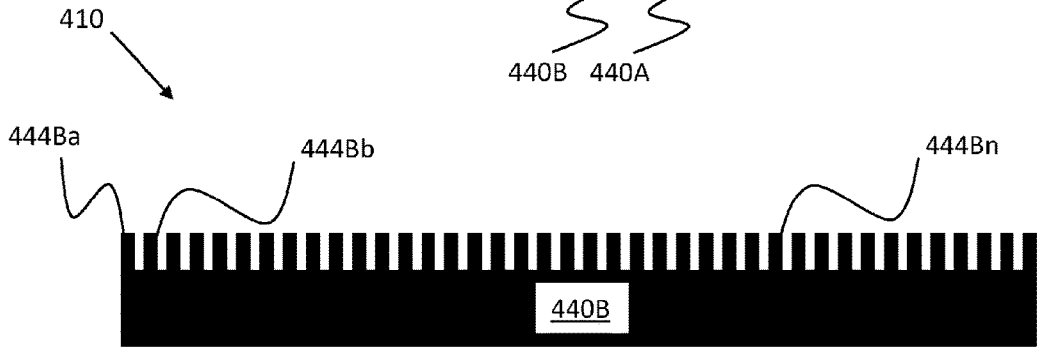

FIGS. 4A-4C show schematic diagrams of a drying apparatus 410, according to an embodiment. In particular, FIG. 4A shows a side view of an embodiment of hair separator 420 which includes a non-planar surface. FIG. 4B shows a side view of an embodiment of hair separator 420 on a planar or flat surface. As shown in FIGS. 4A and 4B, the hair separator 420 includes a plurality of teeth or bristles 422 with varying dimensions. The drying apparatus 410 also includes a water remover 440 that includes two rows of teeth or bristles 444A and 444B for removing water molecules. The plurality of teeth or bristles 422 is similar or substantially similar to those described with respect to FIG. 1 and hence will not be described in further detail.

FIG. 4C shows the front view (cross-sectional) of the water remover 440 without showing the components of the hair separator 420. In this embodiment, the water remover 440 includes two rows of water removing teeth or bristles 444Aa, 444Ab, . . . , 444An (collectively "444A") and 444Ba, 444Bb, . . . , 444Bn (collectively "444B"). The water removing teeth or bristles 444A and 444B are similar or substantially similar to the teeth, bristles, spikes, and the likes of a comb or brush those described in the water remover 140 with respect to FIG. 1 and hence will not be described in further detail. In some embodiments, the water remover 440 can include 3 or more rows of teeth or bristles.

Figure 5A:
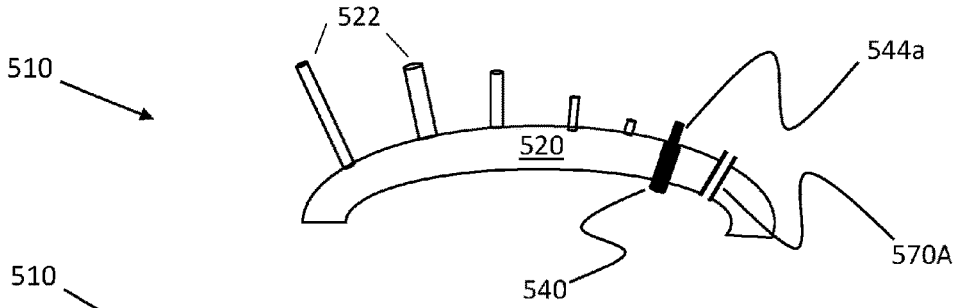
FIGS. 5A-5C show schematic diagrams of a drying apparatus, according to an embodiment.
Figure 5B:
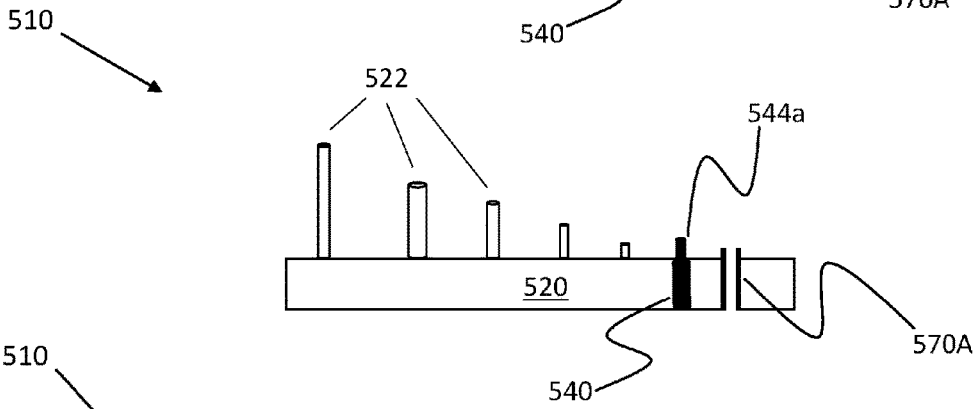
Figure 5C:
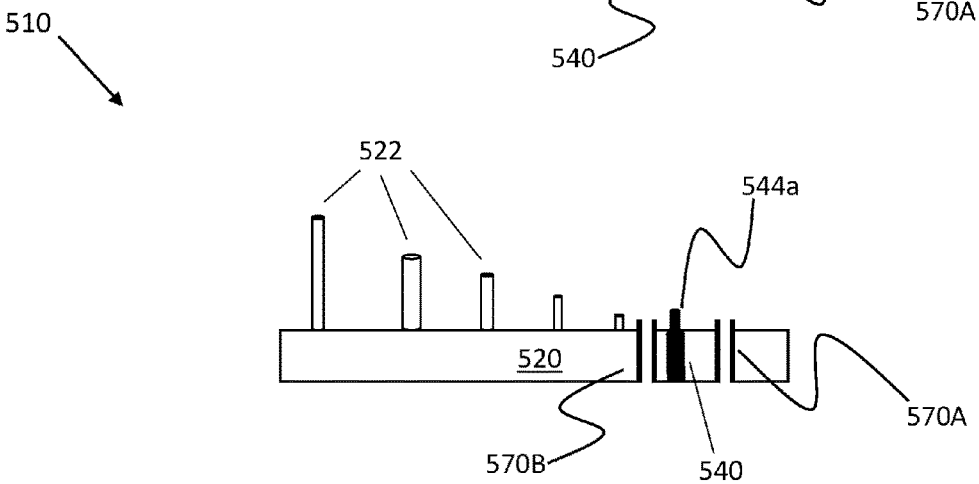

FIGS. 5A-5C show schematic diagrams of a drying apparatus 510, according to an embodiment. In particular, FIG. 5A shows a side view of an embodiment of hair separator 520 which includes a non-planar surface. FIG. 5B shows a side view of an embodiment of hair separator 520 on a planar or flat surface. As shown in FIGS. 5A and 5B, the hair separator 520 includes a plurality of teeth or bristles 522 with varying dimensions. The drying apparatus 510 also includes a water remover 540 that includes a row of teeth or bristles 544*a* for removing water molecules. In addition, the drying apparatus 510 further includes an air blower 570A which can include one row of vents (570A) in FIG. 5B and two rows (570A and 570B) of vents in FIG. 5C. The plurality of teeth or bristles 522 and 544*a* are similar or substantially similar to those described with respect to FIG. 1 and hence will not be described in further detail. The one or more rows of vents 570A and 570B are similar or substantially similar to those described in the air blower 170 with respect to FIG. 1 and hence will not be described in further detail.

Figure 6A:
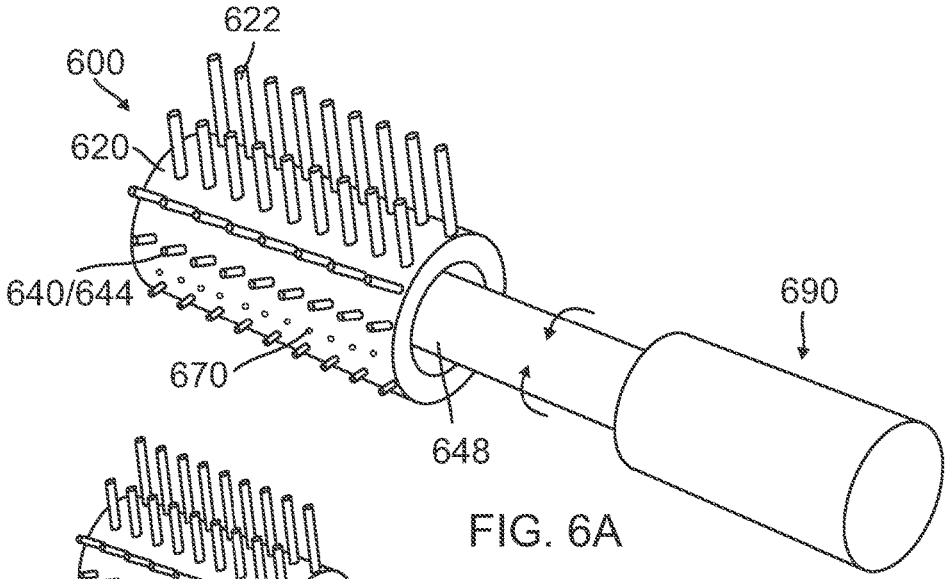
FIGS. 6A-6C show schematic diagrams of a drying system, according to an embodiment.
Figure 6B:
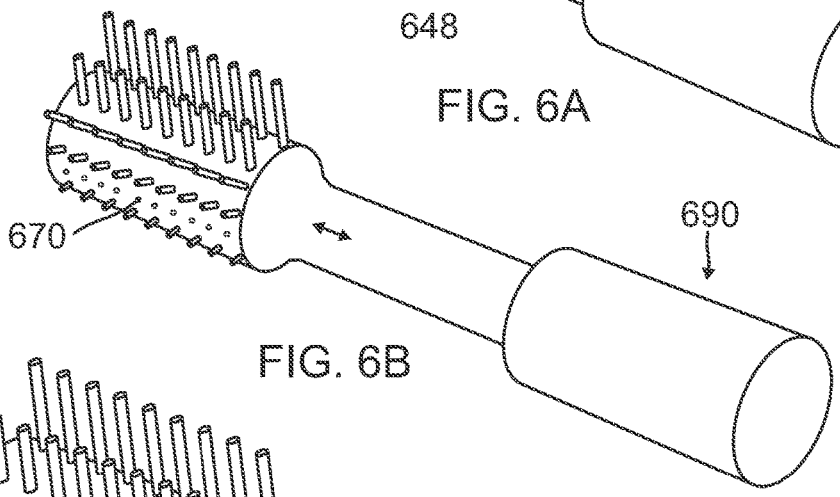
Figure 6C:
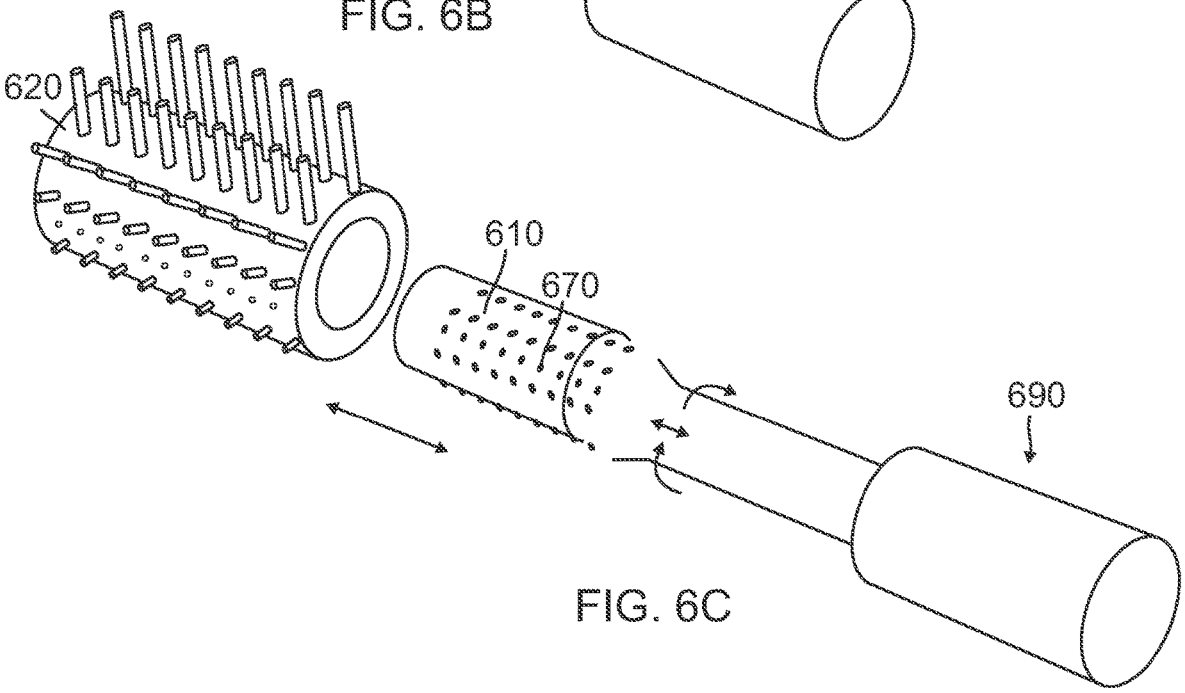

FIGS. 6A-6C show schematic diagrams of a drying system 600, according to an embodiment. As shown in FIGS. 6A-6C, the drying system 600 includes the drying apparatus 610, which includes a hair separator 620 including a plurality of teeth or bristles 622, a water remover 640 including a plurality of teeth or bristles 644, an air blower 670, and a power supply 690. The arrow 648 shows the movement direction of the water remover 640/644. FIG. 6C shows an embodiment in which the hair separator 620 can be reversibly coupled to the drying apparatus 610/drying system 600. In this instance, another hair separator 620 having a different set of components/teeth/bristles with different spacing, widths, aspect ratio, etc. can be used with the drying system 600 or drying apparatus 610. In some embodiments, a clickable or locking mechanism, or any other suitable method can be used to secure the hair separator 620 to the drying apparatus 610. In some embodiments, the hair separator 620 can be rotated manually or automatically, and the rotation can be powered or not powered.

Figure 7A:
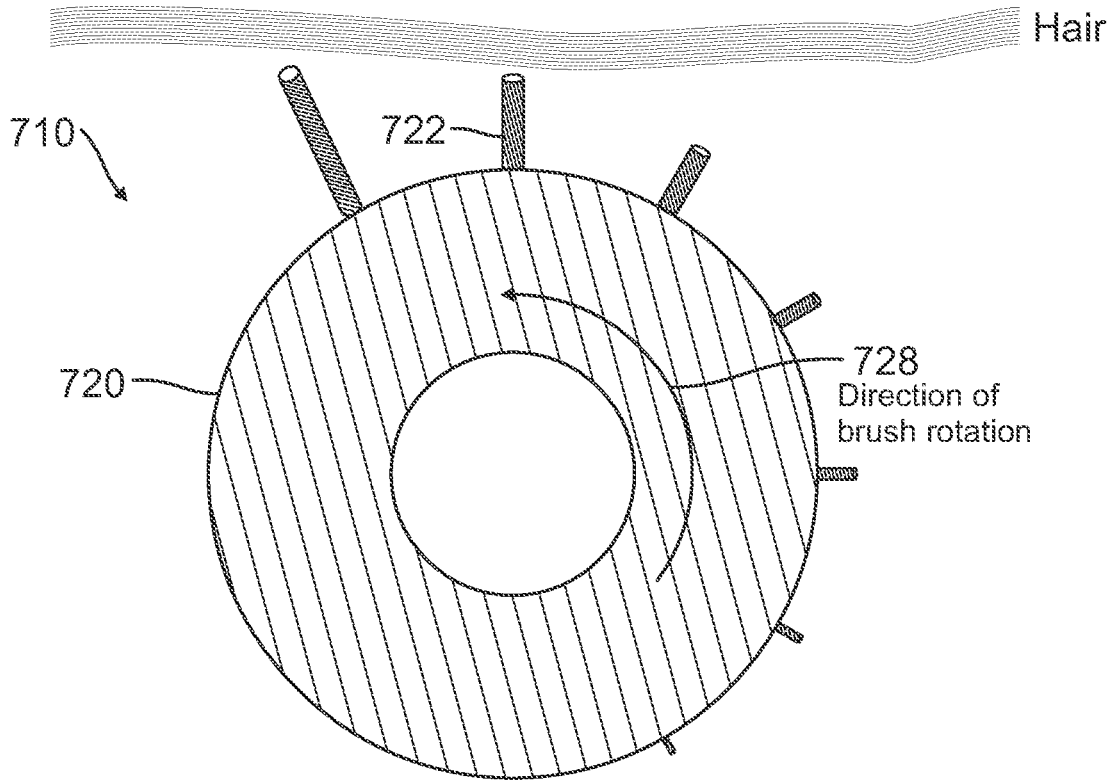
FIGS. 7A-7B show schematic diagrams of a drying apparatus, according to an embodiment.
Figure 7B:
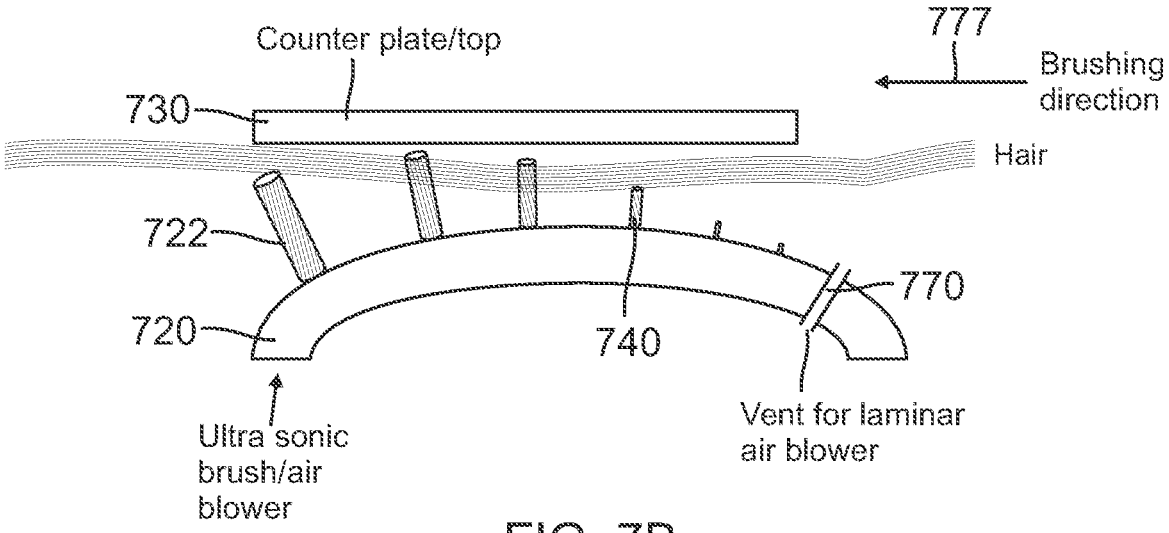

FIGS. 7A and 7B show schematic diagrams of a drying apparatus 710, according to an embodiment. In this embodiment, the cross-sectional view of the drying apparatus 710 shows a hair separator 720 including a plurality of teeth or bristles 722. This illustration in FIG. 7A shows the direction of rotation 728 for the hair separator 720/drying apparatus 710 with respect to the hair. FIG. 7B shows an embodiment, in which the hair separator 720 is used with a counter plate 730 to ensure the hair can be placed under tension when drying. FIG. 7B also shows a water remover 740, an air blower 770 vents and the direction of brushing or drying 777 along the length of hair.

The invention claimed is:

1. An apparatus comprising:

a hair separator to increase surface area of wet hair; and a water remover for creating a mechanical motion at a frequency range from 5 Hz to 5 MHz to mechanically remove water from the wet hair, wherein the hair separator and the water remover each comprise a row of bristles and wherein the row of bristles of the hair separator is adjacent to, and oriented in a same direction as, the row of bristles of the water remover.

2. The apparatus of claim 1, wherein the hair separator comprises another row of bristles with a spacing that is narrower than a spacing of the row of bristles of the hair separator.

3. The apparatus of claim 1, wherein the water remover comprises another row of bristles that is parallel to the row of bristles of the hair separator and the row of bristles of the water remover.

4. The apparatus of claim 1, further comprising:

a row of vents configured to provide a laminar flow of air to remove water, wherein the row of vents is placed adjacent to the row of bristles of the water remover.

5. The apparatus of claim 1, wherein the hair separator is disposed on a substrate, the substrate is rotating or swiveling.

6. The apparatus of claim 1, further comprising;

at least one of: a sonic or an ultrasonic source.

7. The apparatus of claim 1, further comprising: at least one of a battery, a fuel cell, an electrochemical energy source, a renewable energy source, a rechargeable energy source, or an inductive charging pad for wireless charging.

8. The apparatus of claim 1, further comprising: at least one of a temperature sensor to measure temperature, a humidity sensor to measure humidity, a timing device that can track time, a communication component, including WiFi, Bluetooth, Near Field Communication for connecting with an external computing device, a network or a notification system.

9. The apparatus of claim 1, wherein the row of bristles of the hair separator and the row of bristles of the water remover are parallel.

10. An apparatus comprising:

a first article for separating wet hair, the first article having a first row and a second row of bristles, the second row having a narrower spacing of bristles than the first row;

a second article for imparting water from the wet hair, the second article having a plurality of bristles moving at a frequency range from 5 Hz to 5 MHz, wherein the plurality of bristles of the second article are oriented in a same direction as the first row and second row of bristles of the first article; and at least one of a battery, a fuel cell, an electrochemical energy source, a renewable energy source, a rechargeable energy source, or an inductive charging pad for wireless charging.

11. The apparatus of claim 10, further comprising:

a plurality of vents for providing a laminar flow of air to remove water, wherein the plurality of vents are placed between the first article and the second article.

12. The apparatus of claim 10, wherein the plurality of bristles moves in a substantially transverse direction across the wet hair, and parallel to the first row and second row of bristles.

13. The apparatus of claim 10, wherein the plurality of bristles of the second article are configured to move in a direction parallel to the first row and second row of bristles of the first article.

14. The apparatus of claim 10, wherein the plurality of bristles of the second article form a first row and a second row, the second row having a narrower spacing of bristles than the first row.

15. The apparatus of claim 10, further comprising: at least one of a temperature sensor to measure temperature, a humidity sensor to measure humidity, a timing device that can track time, a communication component, including WiFi, Bluetooth, Near Field Communication for connecting with an external computing device, a network or a notification system.

16. A method of drying, the method comprising:

separating wet hair to increase surface area of the wet hair via a first, a second, and a third row of bristles, wherein a spacing of the third row of bristles is narrower than a spacing of the second row of bristles, and the spacing of the second row of bristles is narrower than a spacing of the first row of bristles;

inducing tension of the wet hair by placing the first, second, and third row of bristles in contact with the wet hair;

mechanically removing water from the wet hair using a plurality of water removing bristles, wherein removing occurs while the hair is under tension during contact with the first, second, and third row of bristles; and removing water by a laminar air flow.

17. The method of claim 16, wherein the plurality of water removing bristles move at a frequency range from 5 Hz to 5 MHz.

18. The method of claim 16, wherein the plurality of water removing bristles moves in a substantially transverse direction across the wet hair.

19. The method of claim 16, further comprising:

inductively charging at least one of: a battery, an electrochemical energy source, or a rechargeable energy source via a charging pad.

20. The method of claim 16, wherein the laminar air flow is provided to remove water molecules removed during mechanical removal of water from the wet hair.

* * * * *